US007937004B2

(12) United States Patent
Ikeda

(10) Patent No.: US 7,937,004 B2
(45) Date of Patent: May 3, 2011

(54) IMAGE FORMING APPARATUS HAVING REPLACEABLE COMPONENTS

(75) Inventor: Takemasa Ikeda, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 514 days.

(21) Appl. No.: 12/039,498

(22) Filed: Feb. 28, 2008

(65) Prior Publication Data

US 2009/0097871 A1 Apr. 16, 2009

(30) Foreign Application Priority Data

Oct. 10, 2007 (JP) ..... 2007-264509

(51) Int. Cl.
*G03G 15/00* (2006.01)

(52) U.S. Cl. ..... 399/44; 399/12

(58) Field of Classification Search ..... None
See application file for complete search history.

(56) References Cited

U.S. PATENT DOCUMENTS

2002/0003966 A1* 1/2002 Iwaki et al. ..... 399/12

FOREIGN PATENT DOCUMENTS

| | | |
|---|---|---|
| JP | 3-92648 | 9/1991 |
| JP | 07-001790 | 1/1995 |
| JP | 2007-072118 | 3/2007 |
| JP | 2007/188032 | 7/2007 |

OTHER PUBLICATIONS

A Notification of Reasons for Refusal issued by JPO on Aug. 18, 2009, in connection with Appl. No. 2007-264509, 2 pgs.

Translation of a Notification of Reasons for Refusal issued by JPO on Aug. 18, 2009, in connection with Appl. No. 2007-264509, 3 pgs.

* cited by examiner

*Primary Examiner* — David M Gray
*Assistant Examiner* — Roy Yi
(74) *Attorney, Agent, or Firm* — Squire, Sanders & Dempsey (US) LLP

(57) ABSTRACT

Disclosed is an image forming apparatus which forms an image on a paper including a detection unit to detect a present temperature of one component or a plurality of components to be replaced among components constituting the image forming apparatus and a control unit to determine whether the component is replaceable or not based on the detected present temperature and to execute a replacement guide for the component which is determined to be replaceable.

4 Claims, 7 Drawing Sheets

IMAGE FORMING APPARATUS HAVING REPLACEABLE COMPONENTS

BACKGROUND OF THE INVENTION

1. Field of the Invention

The present invention relates to an image forming apparatus such as a copier, a printer, a facsimile and the like.

2. Description of Related Art

In an image forming apparatus such as a printer or the like, a replacement guide takes place so that a user himself/herself can replace the components such as a toner cartridge, a drum cartridge and the like. The replacement guide allows the replacement be completed safely, and reduces the time needed for the replacement to realize an efficient replacement. Further, the replacement guide is a guide for recovering the operation of the image forming apparatus as much as possible.

The replacement guide provides voice prompts and displays illustrations of the process and method of the replacement so that the replacement operation can be carried out easily and promptly without a user preparing the operating manual (for example, see JP7-1790A and JP2007-72118A).

However, among the components, there are a part which becomes high temperature such as a fixing unit or the like, a part which becomes high voltage such as a drum cartridge, and the like. The replacement frequency of such components is low, and in many cases, a use is not used to the replacement. A user needs to be well reminded because there may be a case where a user who is not used to the replacement accidentally touches the high temperature fixing unit or the like.

Moreover, it is difficult to a user to determine when the component becomes in the condition in which the replacement can take place even when the cooling is started from the high temperature condition. When a user waits longer than necessary, it may result in reduction of operation rate of the image forming apparatus.

Furthermore, when a plurality of components are to be replaced, it is confusing for a use to determine which component he/she should replace first. Therefore, there is a case where the replacement operation is inefficient.

SUMMARY OF THE INVENTION

The main object of the present invention is to realize an easy and safe replacement of the components.

An image forming apparatus which forms an image on a paper of the present invention comprises:

a detection unit to detect a present temperature of one component or a plurality of components to be replaced among components constituting the image forming apparatus; and a control unit to determine whether the component is replaceable or not based on the detected present temperature and to execute a replacement guide for the component which is determined to be replaceable.

BRIEF DESCRIPTION OF THE DRAWINGS

The present invention will become more fully understood from the detailed description given hereinbelow and the appended drawings, and thus are not intended as a definition of the limits of the present invention, and wherein.

DESCRIPTION OF THE PREFERRED EMBODIMENTS

Hereinafter, the embodiment of the image forming apparatus according to the present invention will be described with reference to the drawings.

First, the structure will be described.

Figure 1:
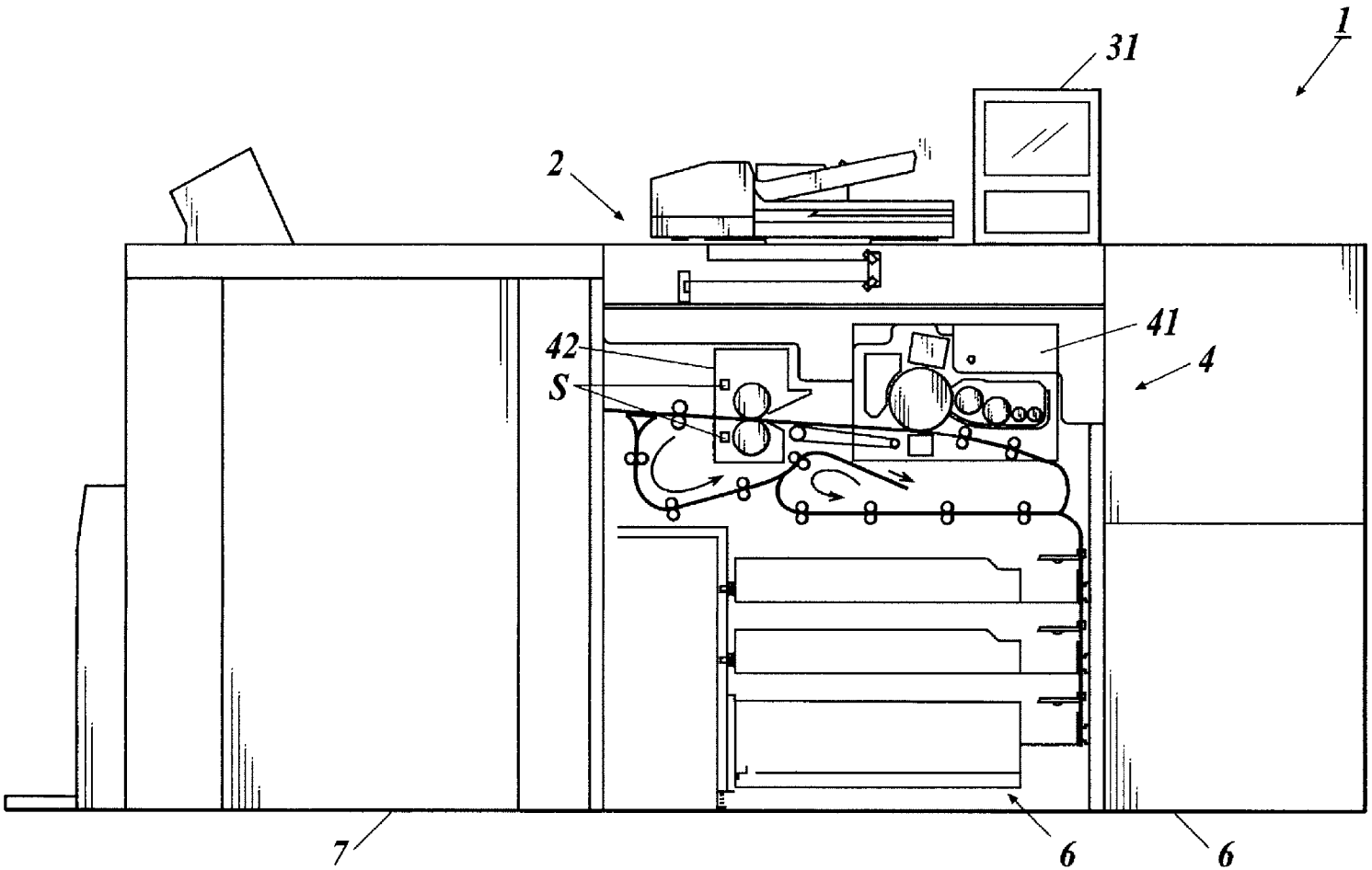
FIG. 1 is a diagram showing an image forming apparatus according to the embodiment.

An outside drawing of an image forming apparatus 1 according to the embodiment is shown in FIG. 1. Here, in FIG. 1, an inside portion of the body part is a perspective view. On the other hand, FIG. 2 shows a functional structure of the image forming apparatus 1.

Figure 2:
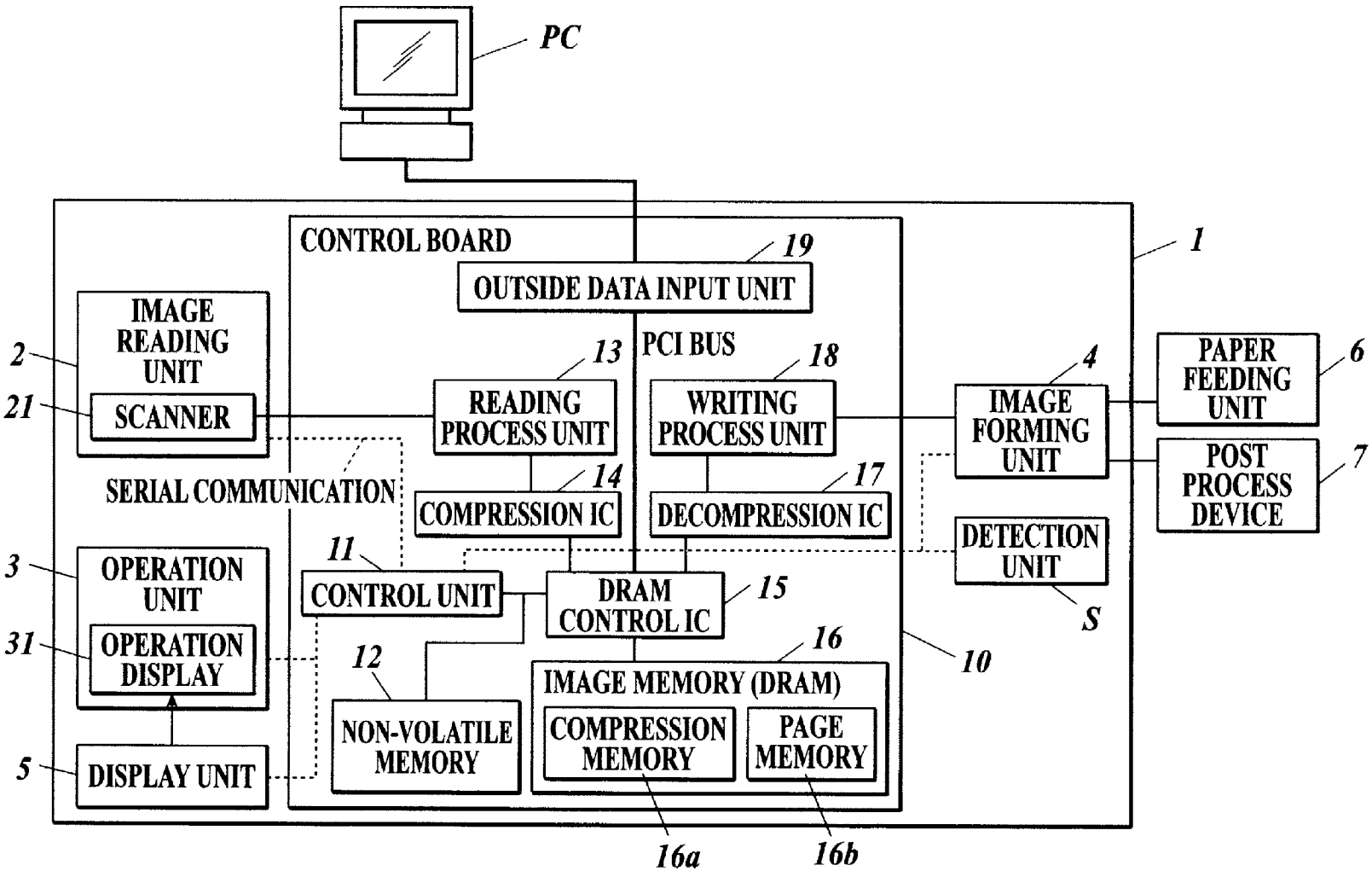
FIG. 2 is a diagram showing a functional structure of the image forming apparatus of FIG. 1.

As shown in FIGS. 1 and 2, the image forming apparatus 1 comprises an image reading unit 2, an operation unit 3, an image forming unit 4, a display unit 5, a paper feeding unit 6, an post-processing device 7, a control board 10 and the like. The image forming unit 4 comprises a fixing unit 42 other than a unit 41 which carries out exposure and development.

Hereinafter, each component will be described.

The image reading unit 2 comprises a scanner 21, the ADF (automatic paper sending mechanism) and the like. The image reading unit 2 carries out the exposure scanning on the document surface which is placed on the document table by the scanner 21, and reads the document image by carrying out the photoelectrical conversion. The analog image signal of the read document image is output to the reading process unit 13 of the control board 10.

The operation unit 3 comprises an operation display 31 which is a touch panel, a group of operation keys (omitted from the drawing) other than the operation display 31, and the like. The operation unit 3 outputs the operation signal which is input from the group of operation keys or the operation display 31 to the control unit 11.

The display unit 5 displays the operation screen, various types of processing results and the like for inputting the image forming condition and the post-processing condition on the operation display 31 according to the display signal which is input from the control unit 11.

The image forming unit 41 comprises the unit 41 which is constituted of an exposure unit, a photoconductor drum, a developing unit and the like, the fixing unit 42 and the like. The image forming unit 41 carries out the image forming on the paper based on the image data which is input from the writing process unit 18 according to the instruction from the control unit 11. First, an electrostatic latent image is formed on the surface of the photoconductor drum by the exposure unit in the unit 41. Then, the latent image is developed by the developing unit and the toner image is formed on the surface of the photoconductor drum, and the toner image is transferred to the paper which is fed from the paper feeding unit 6. Thereafter, the fixing process is carried out in the fixing unit 42, and the paper is sent to the post-processing device 7.

The post-processing device 7 includes a stacker for stacking the papers which are sent from the image forming apparatus 1, and carries out various types of post-processes such as the cutting process, the punching process, the stapling process, the saddle stitching process, the folding process, the bookbinding process and the like of the papers which are stacked on the stacker.

The detection unit S applies a temperature sensor and detects the present temperature of the components of the image forming apparatus 1. The information of the detected temperature is output to the control unit 11. The detection unit S is disposed inside or near the components which are targeted for the detection, for example, it is disposed at the fixing roller of the fixing unit 42 as shown in FIG. 1.

The control board 10 comprise the control unit 11, a non-volatile memory 12, the reading process unit 13, a compression IC (Integrated Circuit) 14, the DRAM (Dynamic Random Access Memory) control IC 15, an image memory 16, an decompression IC 17, the writing process unit 18, the data input unit 19 and the like.

The control unit 11 carries out various types of calculations and also integrally controls the movement of each unit by cooperating with the control program which is stored in the non-volatile memory 12.

The non-volatile memory 12 stores the replacement determination process program according to the invention, the parameter which is used for various types of program, the processed data and the like other than various control programs.

The reading process unit 13 carries out various types of processes such as the analog process, the shading correction process and the like to the analog image signal which is input from the image reading unit 2, and then carries out the A/D conversion process to generated the digital image data. The generated image data is output to the compression IC 14.

The compression IC 14 caries out the compression process to the image data which is input, and outputs the data to the DRAM control IC 15.

The DRAM control IC 15 controls the compression process of the image data by the compression IC 14 and the decompression process of the compressed image data by the decompression IC 17 and controls the input/output of the image data to/from the image memory 16 according to the instruction from the control unit 11. For example, when the storing of the image data which is read by the image reading unit 2 is instructed, the DRAM control IC 15 carries out the compression process by the compression IC 14 to the image data which is input from the reading process unit 13 and stores the compressed image data in the compression memory 16*a* of the image memory 16. Further, the DRAM control IC 15 reads the compressed image data from the compression memory 16*a* at the time of image forming, carries out the decompression process by the decompression IC 17, and stores the data in the page memory 16*b*. Next, The DRAM control IC 15 reads the non-compressed image data from the page memory 16*b* and outputs the data to the writing process unit 18.

The image memory 16 comprises the compression memory 16A and the page memory 16*b* which are constituted of the DRAM. The compression memory 16*a* is a memory for storing the compressed image data, and the page memory 16*b* is a memory for temporarily storing the non-compressed image data.

The decompression IC 17 carries out the decompression process to the compressed image data to be input.

The writing process unit 18 generates data for image forming based on the image data which is input from the DRAM control IC 15, and outputs the data to the image forming unit 4.

The outside data input unit 19 comprises the communication interface such as the network interface card or the like, the data control unit and the like. The outside data input unit 19 received the image data which is input from the outside user terminal PC by the communication interface via the LAN, and outputs the received image data to the DRAM control IC 15 by the data control unit.

Next, the operation will be described.

Figure 3:
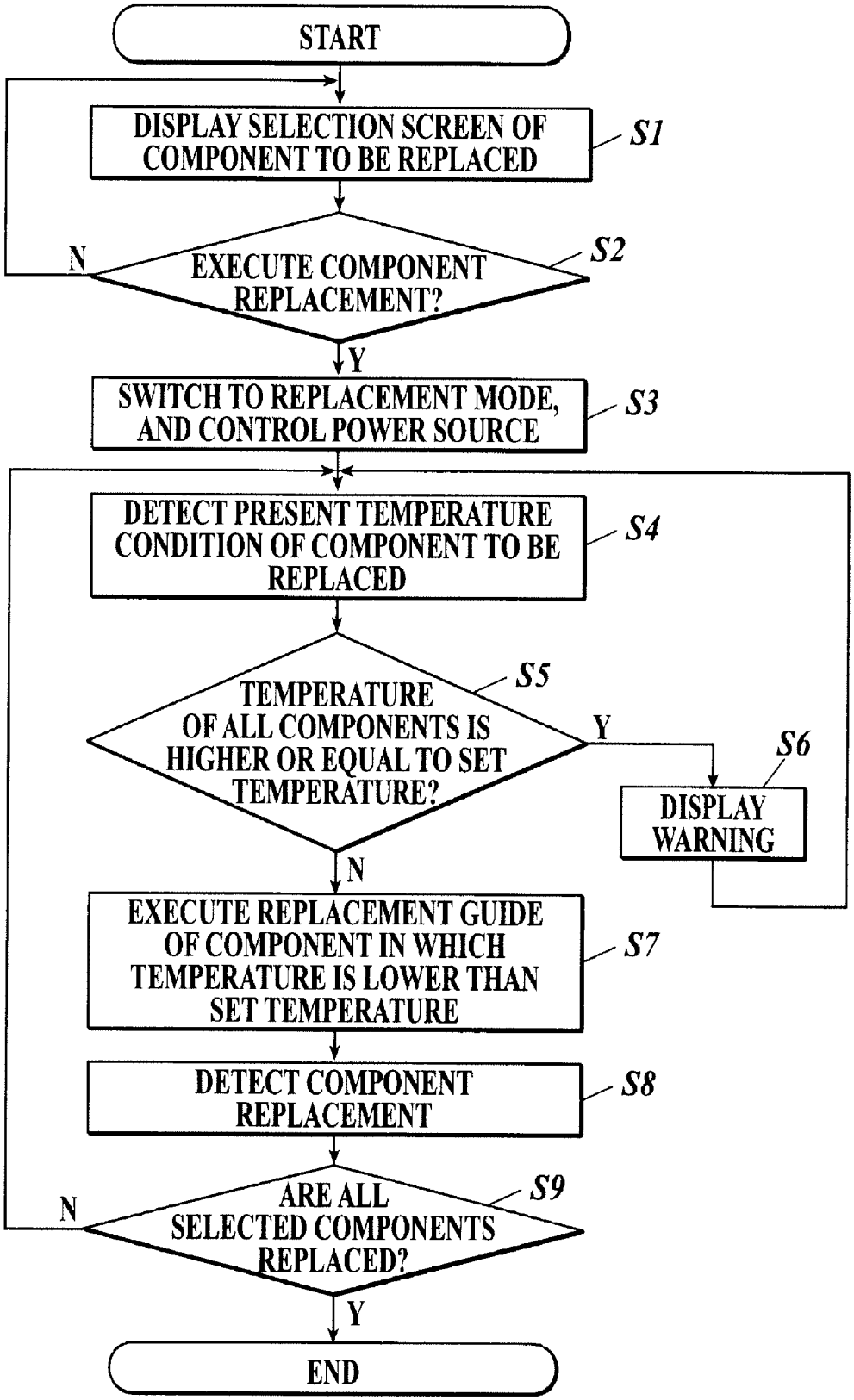
FIG. 3 is a flowchart showing a replacement determination process which is executed by the image forming apparatus.
Figure 4:
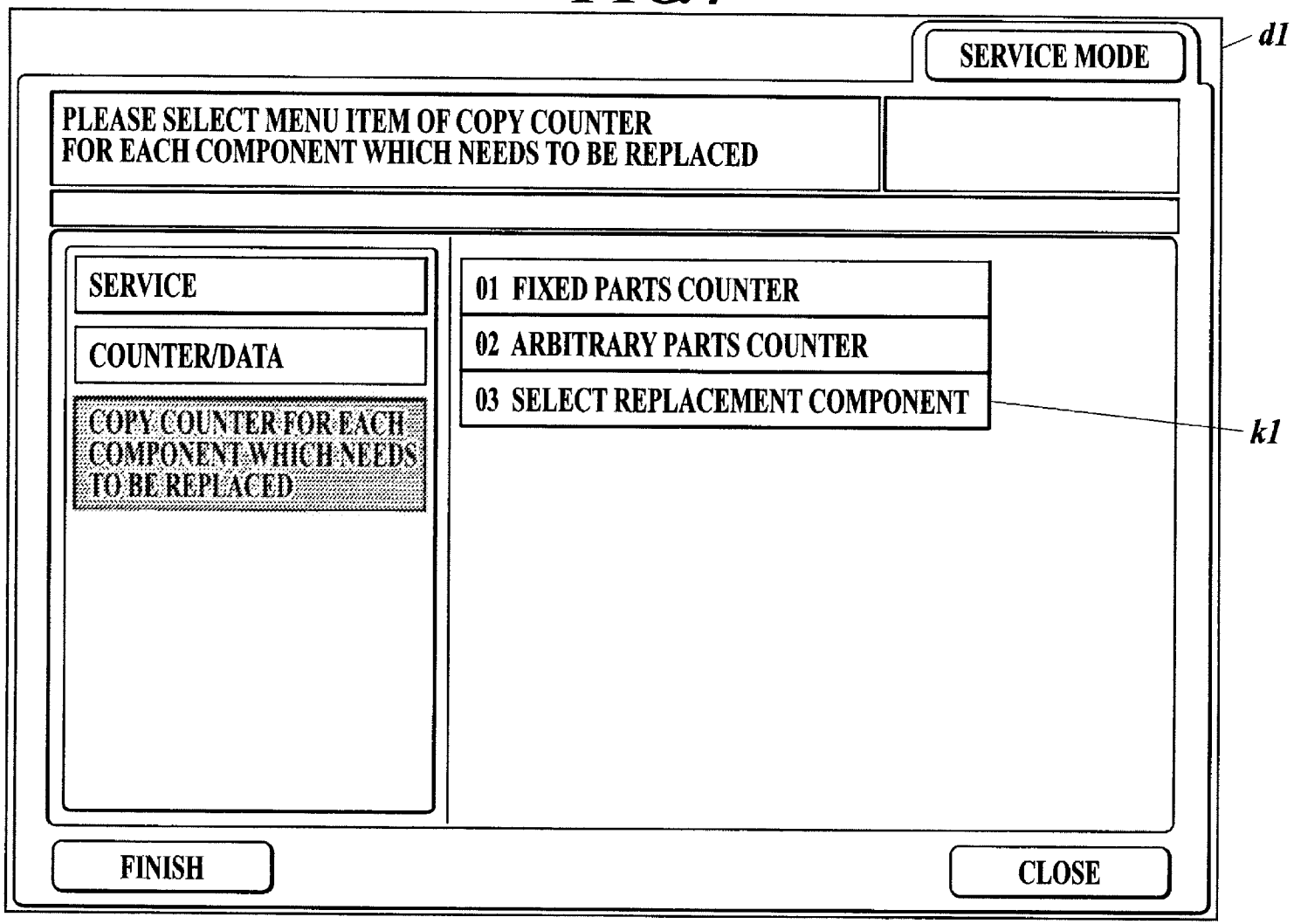
FIG. 4 is a diagram showing an example of an operation screen.

FIG. 3 is a flowchart showing the flow of the replacement determination process which is executed in the image forming apparatus 1 when the component is to be replaced. The description is given on the premise that the selection operation of the menu of the component replacement is carried out by a user and that the operation screen d1 as shown in FIG. 4 is displayed on the operation display 31.

When the replacement component selection key k1 is operated by a user on the operation screen d1, the control unit 11 displays the selection screen d2 (see FIG. 5) for selecting the component to be replaced on the operation display 31 as shown in FIG. 3 (step S1).

Figure 5:
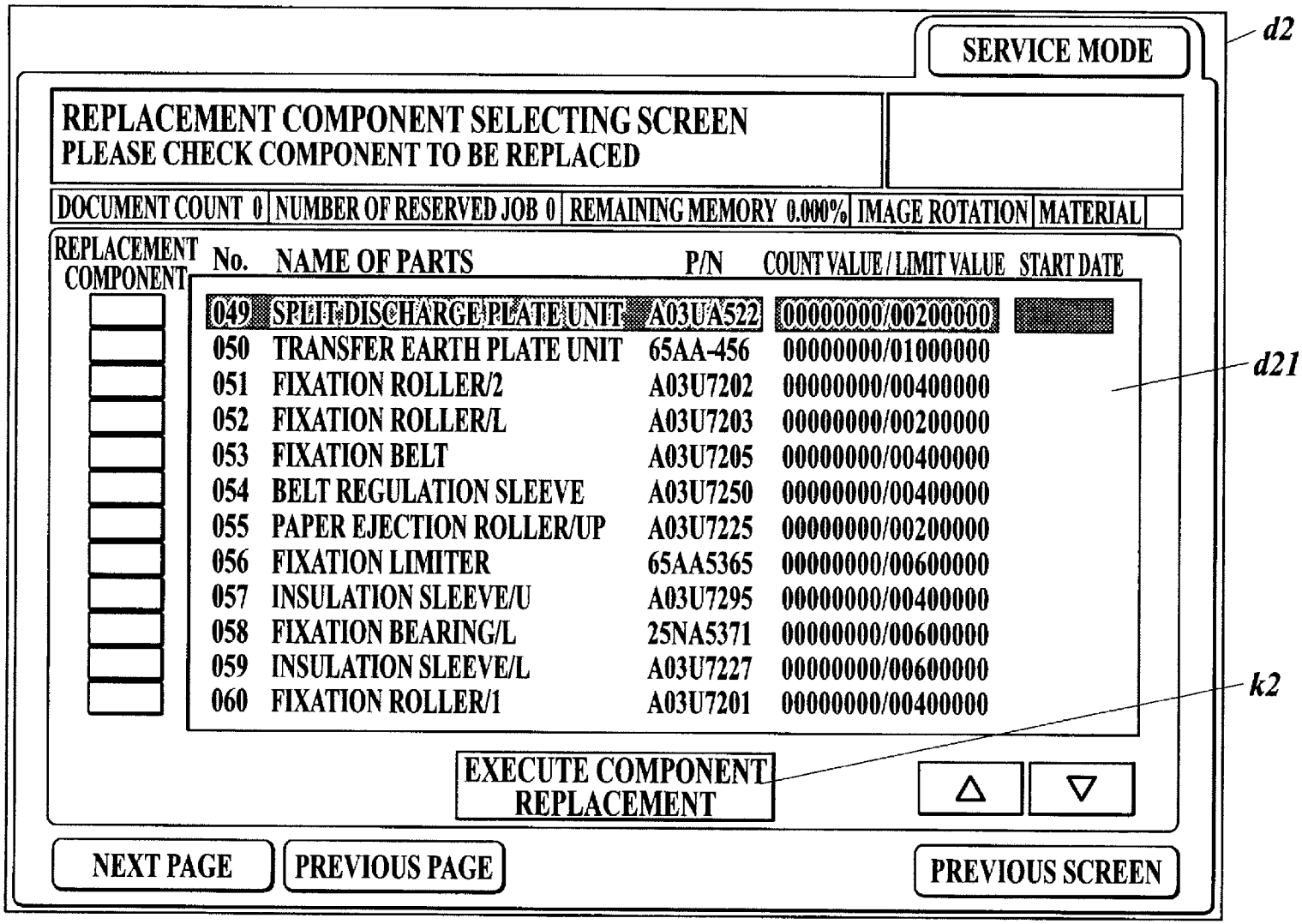
FIG. 5 is a diagram showing an example of a selecting screen.

As shown in FIG. 5, the control unit 11 displays the list d21 of the components which are determined that they need to be replaced on the selection screen d2. Whether the component needs to be replaced or not is determined by whether the component have reached the times of use, the time elapsed and the like which are set as the limit values of the replacement timing for the component since the last replacement day of the component, for example. The name, the count value (the count value of the times of use and the time elapsed since the last replacement day) and the limit value, the last replacement day and the like of the component are displayer in the list d21.

A user selects one component or a plurality of components to be replaced among the list d21 via the operation unit 3. When the selecting is finished, a user operates the component replacement execution key k2.

When the component replacement execution key k2 is operated, the control unit 11 determines that the execution of the component replacement is instructed (step S2; Y) and switches the operation mode of the image forming apparatus 1 to the replacement mode. Then, the control unit 11 carries out the power source control according to the replacement mode (step S3). In the replacement mode, the control unit 11 supplies power only to the components which are needed to be activated at the time of replacement and shuts down the other powers to assure the safety of a user at the time of component replacement. Here, power is supplied to the control unit 11 which is needed to be activated to carry out the process of replacement guide, the operation unit 3 and the detection unit S which is needed to be activated to determine whether the replacement is executable or not, and other powers are shut off.

Subsequently, the present temperature condition of all the components which are selected as the components to be replaced is detected by the detection unit S (step S4). Then, the control unit 11 determines whether the present temperature of all the selected components is higher or equal to the set temperature or not (step S5). The set temperature is stored in the non-volatile memory 12 in advance as a temperature which is safe for a user to touch the component when the component is lower than the temperature, and the control unit 11 reads and uses the set temperature to make the determination.

Figure 6:
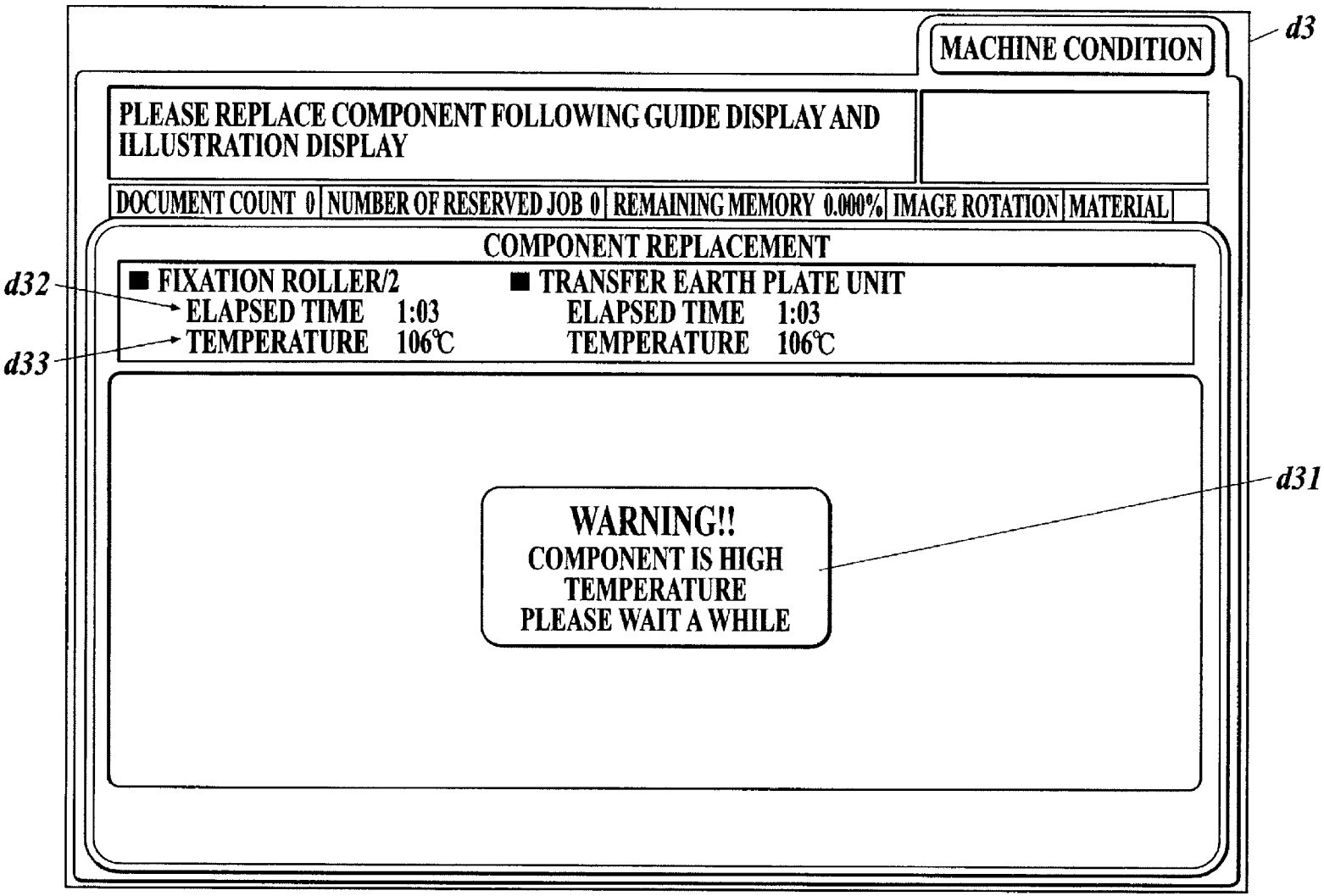
FIG. 6 is a diagram showing an example of a warning screen.

When the temperature of all the components is higher or equal than the set temperature (step S5; Y), the control unit 11 determines that the replacement of the component cannot be carried out and carries out the process of warning that the component cannot be replaced and displays the warning screen d3 as shown in FIG. 6 on the operation display 31 (step S6). In the warning screen d3, the control unit 11 displays the warning message d31 which notifies to wait to replace the component because the component is high temperature and also displays the information of the time elapsed d32 since the component replacement execution key k2 is pressed and the information of the detected present temperature condition d33. This information is displayed as a guideline for a user to determine how long he/she needs to wait till the component cools down to the set temperature. When a plurality of components are selected, the control unit 11 displays the temperature condition d33 for each of the components.

Then, the process returns to the process of step S6, and the control unit 11 repeats the detection of the temperature condition and continues to display the warning screen d3 until the temperature of the component is lower than the set temperature.

Figure 7:
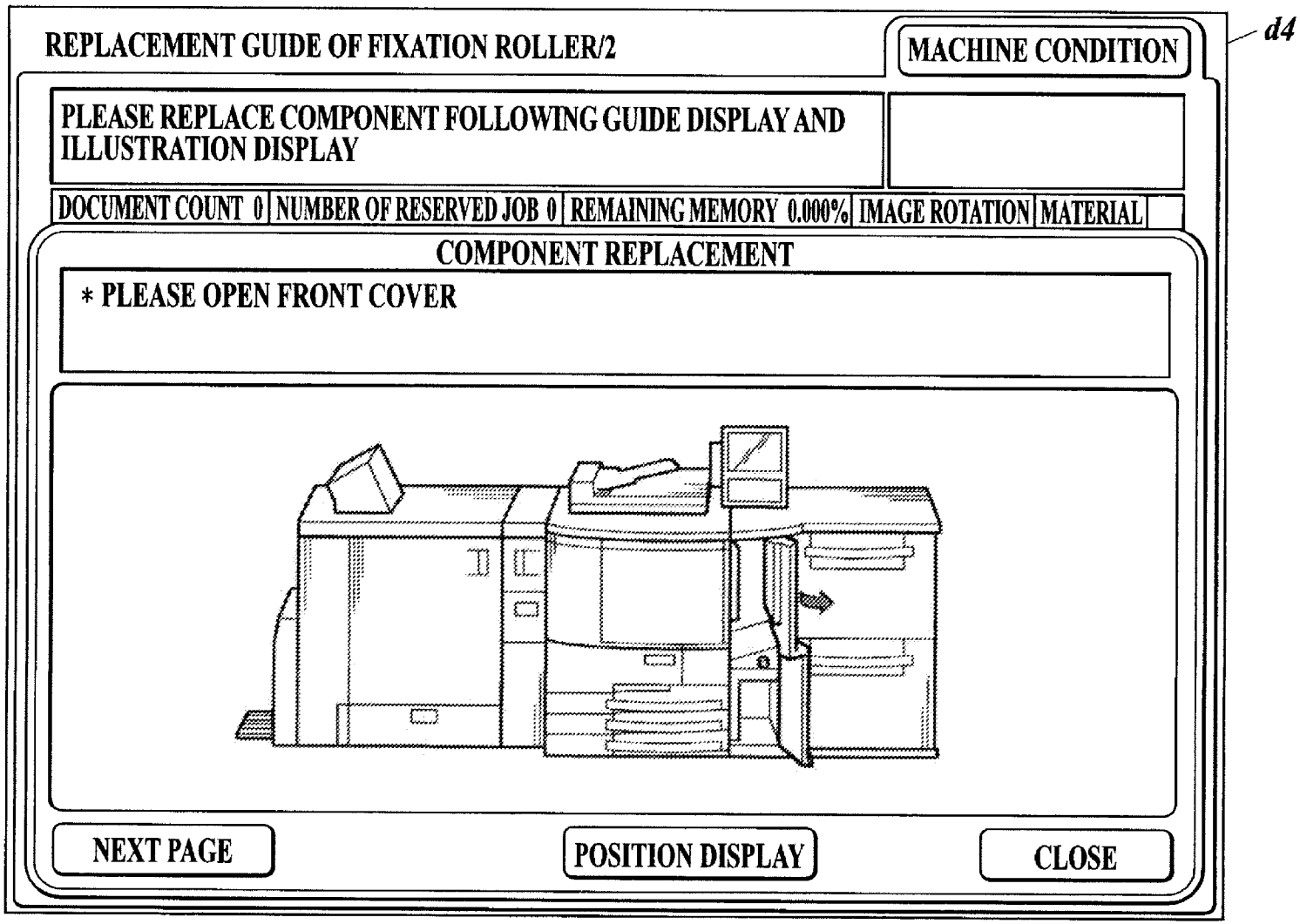
FIG. 7 is a diagram showing an example of a guiding screen.

On the other hand, when there is at least one component in which the temperature is lower than the set temperature among the selected components (step s4; N), the control unit 11 determines that the replacement can be carried out for the component in which the temperature is lower than the set temperature and executes the replacement guide only for the component in which the temperature is lower than the set temperature (step S7). The replacement guide is a process in which the guide screen according to the component replacement is displayed on the operation display 31 or in which the audio of the guide is output from the speaker. For example, as shown in FIG. 7, the control unit 11 displays the guide screen d4 which explains the replacement process by an illustration on the operation display 31.

A user can carry out the replacement of the component which is suggested to be replaced in the guide screen d4 by referring to the guide screen d4.

When it is detected that the replacement of the component according to the replacement guide is carried out by a user by the structural parts which include the component (step S8), the control unit 11 determines whether the replacement of all the components which are selected as components which need to be replaced is finished or not (step S9). When there is a component in which the replacement is not finished (step S9; N), the control unit 11 returns to the process of step S4 and repeats the process of step S4 to step S9 for the not-yet-replaced component. On the other hand, when the replacement of all the selected components is detected (step S9; Y), the control unit 11 switches to the normal mode from the replacement mode and finishes the process. That is, the control unit 11 restarts the power supply to each part of the image forming apparatus 1 and restores the power source to the normal condition.

As described above, according to the embodiment, the present temperature condition of one component or a plurality of components to be replaced is detected by the detection unit S, and the control unit 11 determines whether each component is replaceable or not from the relation between the detected present temperature condition and the set temperature. The control unit 11 executes the process of replacement guide only for the component in which the detected temperature is lower than the set temperature and which is determined to be replaceable. Therefore, only the components having a high level of safety can be suggested for replacement. Thus, the component replacement can be carried out safely even when a user is not used to the replacement. Further, a user can easily proceed with the replacement operation by the replacement guide.

Moreover, even when the temperature of the component is determined to be higher or equal to the set temperature in the beginning and when the component is determined not to be replaceable, the control unit 11 executes the replacement guide when the temperature becomes lower than the set temperature as time passes. That is, when a plurality of components are to be replaced, the control unit 11 executes the replacement guide for the components in the order from the component which is determined to be replaceable. Therefore, a user can easily know from which component he/she should replace, and the time needed for the replacement can be attempted to be reduced. In such way, the operation rate of the image forming apparatus 1 can be improved.

Furthermore, when the detected temperature of all the components is higher or equal to the set temperature and when the control unit 11 determines that they cannot be replaced, the control unit 11 carries out the warning indicating that the components cannot be replaced. By this warning, a user is reminded not to replace the components.

Moreover, the component to be replaced is selected by a user and the control unit 11 carries out the detection of the present temperature condition by the detection unit S only for the selected component. Therefore, it is efficient because the temperature condition needs to be detected only for the component which is to be actually replaced.

Here, the above described embodiment is a preferred example of the present invention, and the present invention is not limited to this.

For example, in the above described embodiment, the present temperature condition of the component to be replaced is detected. However, other condition may be detected, for example, the voltage condition can be detected by the voltage sensor or the like. By detecting the condition corresponding to the safety which needs to be considered at the time of component replacement and by having a structure in which whether the component is replaceable or not is determined according to the condition, the components can be replaced in the order from the component which became safe similarly as in the case where the temperature is detected.

According to the present invention, an image forming apparatus which forms an image on a paper comprises a detection unit to detect a present temperature of one component or a plurality of components to be replaced among components constituting the image forming apparatus and a control unit to determine whether the component is replaceable or not based on the detected present temperature and to execute a replacement guide for the component which is determined to be replaceable.

In accordance to the present invention, the replacement can be suggested only for the component which reached the temperature condition having a high safety level. Therefore, the component replacement can be carried out safely even when a user is not used to the replacement. Further, a user can easily proceed with the replacement operation by the replacement guide. When there are a plurality of components to be replaced, a user can easily know from which component he/she can replace because the replacement guide is carried out in the order from the component which is determined to be replaceable. As a result, the replacement can be completed efficiently and the operation rate of the image forming apparatus can be improved.

Preferably, the control unit warns that the component which is determined not to be replaceable cannot be replaced.

In such way, a user can be reminded not to replace the components which are determined to be not replaceable.

Preferably, the image forming apparatus further comprises a display unit, and the control unit displays information showing the detected present temperature of the component in the display unit.

In such way, a guideline for determining how long a user needs to wait until the temperature of the component becomes the temperature in which the component can be replaced from the displayed present temperature can be indicated to a user.

Preferably, the image forming apparatus further comprises an operation unit, and the detection unit detect the present temperature of the component which is selected via the operation unit.

In such way, it is efficient because the present temperature needs to be detected only for the component which is selected by a user and which is to be actually replaced.

The present U.S. patent application claims a priority under the Paris Convention of Japanese paten application No. 2007-264509 filed on Oct. 10, 2007, which shall be a basis of correction of an incorrect translation.

What is claimed is:

1. An image forming apparatus which forms an image on a paper, comprises:

a detection unit to detect respective temperatures of a plurality of components which are selected to be replaced among components constituting the image forming apparatus; and a control unit to determine that a component whose detected temperature is less than a predetermined value is replaceable among the selected components and to execute a replacement guide for the component which is determined to be replaceable, after the replacement of the replaceable component is finished, the control unit causing the detection unit to detect again the temperature of a component whose detected temperature was a predetermined value or more among the selected components, and the control unit determining that a component whose detected temperature has become less than a predetermined value is replaceable and executing the replacement guide for the component which is determined to be replaceable.

2. The image forming apparatus of claim 1, wherein the control unit warns that the component which is determined not to be replaceable cannot be replaced.

3. The image forming apparatus of claim 1 further comprising a display unit, wherein the control unit displays information showing the detected temperature of the component in the display unit.

4. The image forming apparatus of claim 1 further comprising an operation unit, wherein the detection unit detects the temperature of the component which is selected via the operation unit.

* * * * *